US006207337B1

(12) United States Patent
Swain

(10) Patent No.: US 6,207,337 B1
(45) Date of Patent: Mar. 27, 2001

(54) IMMERSION COATING SYSTEM

(75) Inventor: Eugene A. Swain, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/411,267

(22) Filed: Oct. 4, 1999

(51) Int. Cl.[7] ..... G03G 5/04; B05D 1/18
(52) U.S. Cl. ..... 430/127; 427/403.1; 118/429
(58) Field of Search ..... 430/132, 127; 427/430.1; 118/69, 429

(56) References Cited

U.S. PATENT DOCUMENTS

| | | | | |
|---|---|---|---|---|
| 5,334,246 | | 8/1994 | Pietrzykowski, Jr. et al. | 118/69 |
| 5,599,646 | * | 2/1997 | Foley et al. | 430/132 |
| 6,096,470 | * | 8/2000 | Fuller et al. | 430/132 |

* cited by examiner

*Primary Examiner*—John Goodrow
(74) *Attorney, Agent, or Firm*—John L. Haack; Peter H. Kondo

(57) ABSTRACT

A material handling system for dip coating at least a first drum having a first predetermined length in a first coating cycle and a second drum of a second different predetermined length in a different coating cycle including a carrier device for carrying at least one drum, a coating bath container for depositing a layer of coating material onto at least one drum, a mechanism for raising and lowering the coating bath container between at least a first position and a second position higher than the first position, and a transport device for vertically transporting the carrier device a first predetermined distance from a home position for the first drum and a second predetermined different distance from the home position for the second drum, the first predetermined distance from a home position for the first drum and the second predetermined different distance from the home position for the second drum being sufficient to at least partially insert the first drum and second drum, respectively, into the coating bath container while the coating bath container is stationary.

A process for coating the drums is also disclosed.

13 Claims, 3 Drawing Sheets

IMMERSION COATING SYSTEM

BACKGROUND OF THE INVENTION

This invention relates in general to a material handling system for use in a dip coating process, and, more specifically, to a dip coating process system for use in coating drums of different lengths.

Electrostatographic imaging systems, which are well known, involve the formation and development of electrostatic latent images on an imaging surface of an electrostatographic or photoreceptor. Electrostatographic imaging members are well known and commonly comprise, for example, a hollow cylindrical drum substrate coated with one or more coatings. Typical coatings include a charge generating layer and a charge transport layer. An optional blocking layer is often applied to the drum substrate. Such multi-layered photoconductive devices comprising a photogenerating or charge generating layer and a charge transport layer deposited on a conductive substrate have been disclosed in the art, as for example, in U.S. Pat. No. 4,265,990, the entire disclosure of this patent being incorporated herein by reference. These photoreceptor drums are usually fabricated by dip coating.

Dip coating of hollow cylindrical members such as, for example, a pipe for forming a photoconductive drum has conventionally been carried out by sequentially transporting, via automated conveyors, a plurality of drums into independent coating booths separated by driers and cooling zones. In a typical system, transport pallets containing as many as four substrate pipes are received from a final pipe cleaning station along an assembly line and sequentially transferred into three coating booths, one for each of the following coating layers: an undercoating layer (UCL); a charge generating layer (CGL); and a charge transport layer (CTL). Three drying/cooling zones follow each coating booth and, finally, a load/unload robot is utilized, where each coated drum is removed from the assembly line. Each of the three coating booths contains an indexing mechanism for rotating the pipes through a series of stations for applying the respective coating material, each coating booth containing a pallet/pipe transfer station, a dip coating station, a flash-off station, and a bottom edge wipe station.

The operation of the system described above proceeds in the following manner. Initially, two transport pallets of four pipes each are transported along a conveyor to the pallet/pipe transfer station where the pipes (eight at a time) are raised up from the transport pallets for removal and transfer to the indexing machine. The indexing machine grasps each pipe from the inside diameter by means of a chucking device for carrying the pipes to each station in the particular coating booth. After receiving the pipes at the pallet/pipe transfer station, the indexer rotates sequentially in 90° increments to deliver the pipes to each processing station. The pipes are first delivered to the dip coating station where a plurality of individual dip tanks are raised around each pipe for receiving each pipe to individually dip coat each pipe. In this manner, the dip tanks are raised around the pipes, come to rest with the pipes therein, and finally lowered in accordance with a specific time and velocity profile for providing a coating having a predetermined thickness for the particular layer being applied to the pipe.

After the pipes have been dipped for a predetermined amount of time, the dip tanks are lowered away from the pipes and the indexing mechanism rotates to transport the pipes to a flash-off station. At this station, solvent vapor from the coating formula is allowed to dissipate or "flash-off".

After a sufficient flash-off time, the indexer once again rotates to a bottom edge wipe station. At this station, a boundary area of approximately 11 mm along the bottom rim of the coated pipe is cleaned off by means of a combination solvent and brush contact to remove the coating layer deposited thereon. This bottom edge wipe step is necessitated by the fact that the bottom edge portion of the drum is used as an electrical contact point when placed in the electrostatographic machine and, moreover, because the coated pipe is subsequently removed from the indexer and placed on a transport pallet for transport to the next processing a subsequent processing station.

Thus, upon completion of the bottom edge wipe process step, the bottom edge solution tank is lowered away from the pipes and the indexer is rotated another 90° to return the pipes to the pallet/pipe transfer station. At this stage, the pipes are lowered back onto the transport pallets, returned to the automated conveyor and transported along the conveyor to a drying and cooling station. As described, this process is repeated for each of three coating layers dip coated onto each hollow pipe for producing a drum-type photoreceptive member.

The above-described dip coating system and process has many disadvantages. The primary disadvantage of this system involves the fact that each step in dip coating a layer of material onto a pipe includes a transfer step wherein the pipes are shifted from the transport pallets on the automated conveyor into each coating booth and subsequently again shifted from each coating booth back to the transport pallets. In fact, it is this very step of transferring each pipe back to the transport pallet that necessitates the bottom edge wipe process at each coating booth for preventing contamination of this coating layer as well as for preventing residual coating material to be deposited on the transfer pallet. Clearly, since this bottom edge wipe process is separately repeated for each layer of the dip coating process, the elimination of this step is desirable and would be greatly advantageous in increasing production throughput, in decreasing overall production facility cost and in ultimately decreasing product cost.

A major disadvantage of the dip coating process system presently in use concerns real estate requirements; that is, in the known system in present use, each dip coating booth must be separately laid out and separated by an independent drying and cooling station for dip coating an individual layer on each workpiece. It is evident that each separate and independent dip coating booth and oven/cooling station requires an incremental addition to physical space. This is not only important in terms of the size requirements of the manufacturing facility, but is also Important in determining the cost of the facility and, necessarily, the ultimate cost of the photoreceptive drums produced therein. This problem is exacerbated by the fact that the entire assembly line facility including each booth and the conveyor system is preferably housed in a class 100 clean room enclosure.

A further disadvantage of the above-described system results from the requirement for separate dip coating booths including separate and independent hardware to yield essentially the same operation at each booth. In the described system, the indexing mechanism provides essentially the same function in each dip coating booth: transporting the pipes from the pallet/pipe transfer station to the dip coating tank; from the dip coating tank to the flash off station; from the flash-off station to the bottom edge wipe station, and finally, from the bottom edge wipe station back to the pallet/pipe transfer station. It would be advantageous to consolidate these repetitive steps into a singular apparatus which could transport a plurality of drums through each dip coating step of the multilayered dip coating process.

An improvement in dip coat processing is an in-line configuration where the workpieces are attached to a carrier pallet to eliminate load/unload steps at each dip coating station.

In another technique for the dip coating of drums, a drum is suspended from a chuck which is mounted on the lower end of a mandrel or carrier pallet. The mandrel is transported by an overhead conveyor from one dip coating tank to another. When a drum reaches a dip coating position over a coating tank, the mandrel is lowered from a home position to immerse most of the drum in a coating liquid retained in a dip coating tank. In plant production lines, photoreceptor drums of several lengths are coated in different coating runs. In a coating many sizes of photoreceptors, it is difficult to maintain an optimal cycle time. Since the pull rate for dipping is usually constant, a short length drum can be coated in less time than a long drum. However, a line that handles multiple length drums must be constructed so that it can also handle dip coating of long drums. This means that for a short drum a significant amount of time is wasted just moving the chuck and mandrel downwardly to where the coating tanks are located. Thus, for example, a short substrate would have to move 250 mm downwardly in order to contact the coating solution. At a lowering speed of 1000 mm/minute, this is 15 seconds of lost time as compared to a long substrate having a length of 500 mm. Again, when the coating cycle has been completed and the substrate must be raised to its home position, another extra 250 mm must be traversed at a time of 15 seconds for a total lost time of 30 seconds. This problem is exacerbated when a coating line must apply a plurality of coats of different materials to each drum at different coating stations. Thus, when a production line is set up for dip coating long drums, such as drums used for double width printing, significant cycle time is lost when the line is subsequently used to coat short drums. More specifically, time is lost because the chuck must be moved a greater distance from the home position to (1) dip a short drum into the coating liquid in the dip coating tank and (2) remove the short drum from the coating liquid in the dip coating tank back to the home position.

While the above-described photoconductive devices are suitable for their intended purposes, there continues to be a need for the development of improved processes and devices which dip coats drums more efficiently.

INFORMATION DISCLOSURE STATEMENT

The following disclosures may be relevant to various aspects of the present invention:

U.S. Pat. No. 5,334,246 issued to Pietrzykowski, Jr., et al. on Aug. 2, 1994—A dip coat process material handling system and method are disclosed for coating multiple layers of material on a plurality of workpieces, in particular for producing a multi-layer optical photoconductive drum, wherein a plurality of pipes are suspended from a carrier pallet which transports the workpieces through a dip coat cell housing various dip coating stations. The system includes a load/unload station, vertical and horizontal transport systems for transporting the carrier pallet having workpieces loaded thereon to the various dip coating stations, a drying/cooling booth, and a return conveyor system. The invention allows complete dip coat processing to be completed in an in-line configuration while the workpieces are attached to the carrier pallet, thereby eliminating load/unload steps at each dip coating station to provide efficient and flexible processing of materials.

BRIEF SUMMARY OF THE INVENTION

It is, therefore, an object of the present invention to provide an improved coating system for overcoming the above-noted deficiencies.

It is another object of the present invention to provide an improved coating system having vertically movable dip tanks which can be adjusted higher for short photoreceptors and lower for longer photoreceptors.

It is yet another object of the present invention to provide an improved coating system which eliminates the time necessary for vertically movable drum transport devices to travel from a home position to a start of coating position.

The foregoing objects and others are accomplished in accordance with this invention by providing a material handling system for dip coating at least a first drum having a first predetermined length in a first coating cycle and a second drum of a second different predetermined length in a different coating cycle comprising a carrier device for carrying at least one drum, a coating bath container for depositing a layer of coating material onto at least one drum, a mechanism for raising and lowering the coating bath container between at least a first position and a second position higher than the first position, and a transport device for vertically transporting the carrier device a first predetermined distance from a home position for the first drum and a second predetermined different distance from the home position for the second drum, the first predetermined distance from a home position for the first drum and the second predetermined different distance from the home position for the second drum being sufficient to at least partially insert the first drum and second drum, respectively, into the coating bath container while the coating bath container is stationary.

Another aspect of the present invention includes a process for dip coating at least a first drum having a first predetermined length in a first coating cycle and a second drum of a second different predetermined length in a different coating cycle comprising in the first coating cycle positioning at a first location a coating bath for depositing a layer of coating material onto at least one drum, vertically transporting at least one first drum having a first predetermined length a predetermined first distance from a home position to bring the first drum into contact with the coating bath, vertically transporting the first drum back to the home position, in the different coating cycle positioning at a second location the coating bath for depositing a layer of coating material onto at least one drum, vertically transporting at least one second drum having a second different predetermined length a predetermined second different distance from the home position to bring the second drum into contact with the coating bath, and vertically transporting the second drum back to the home position, the first predetermined distance from the home position for the first drum and the second predetermined different distance from the home position for the second drum being sufficient to bring the first drum and second drum, respectively, into contact with the coating bath while the coating bath container is substantially stationary.

DESCRIPTION OF THE DRAWINGS

A more complete understanding of the present invention can be obtained by reference to the accompanying drawings wherein.

Figure 1:
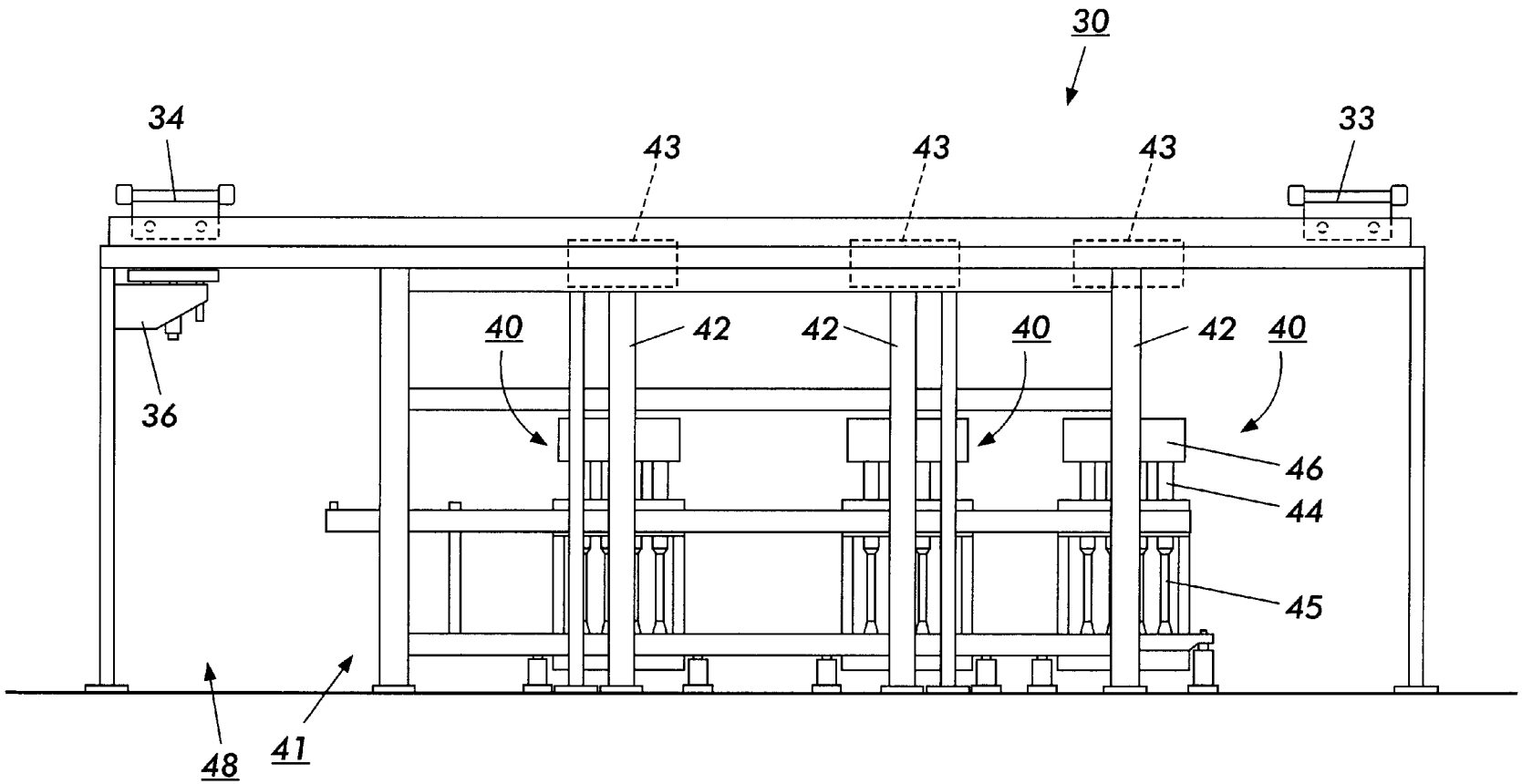
FIG. 1 is a schematic side view showing a dip coat process material handling system in accordance with an embodiment of the present invention.

These figures merely schematically illustrate the invention and are not intended to indicate relative size and dimensions of the device or components thereof.

DETAILED DESCRIPTION OF THE DRAWING

It will be understood that the description that follows is merely intended to describe a possible embodiment of the present invention, and the invention should not be deemed to be limited to the particular embodiment described.

Figure 2:
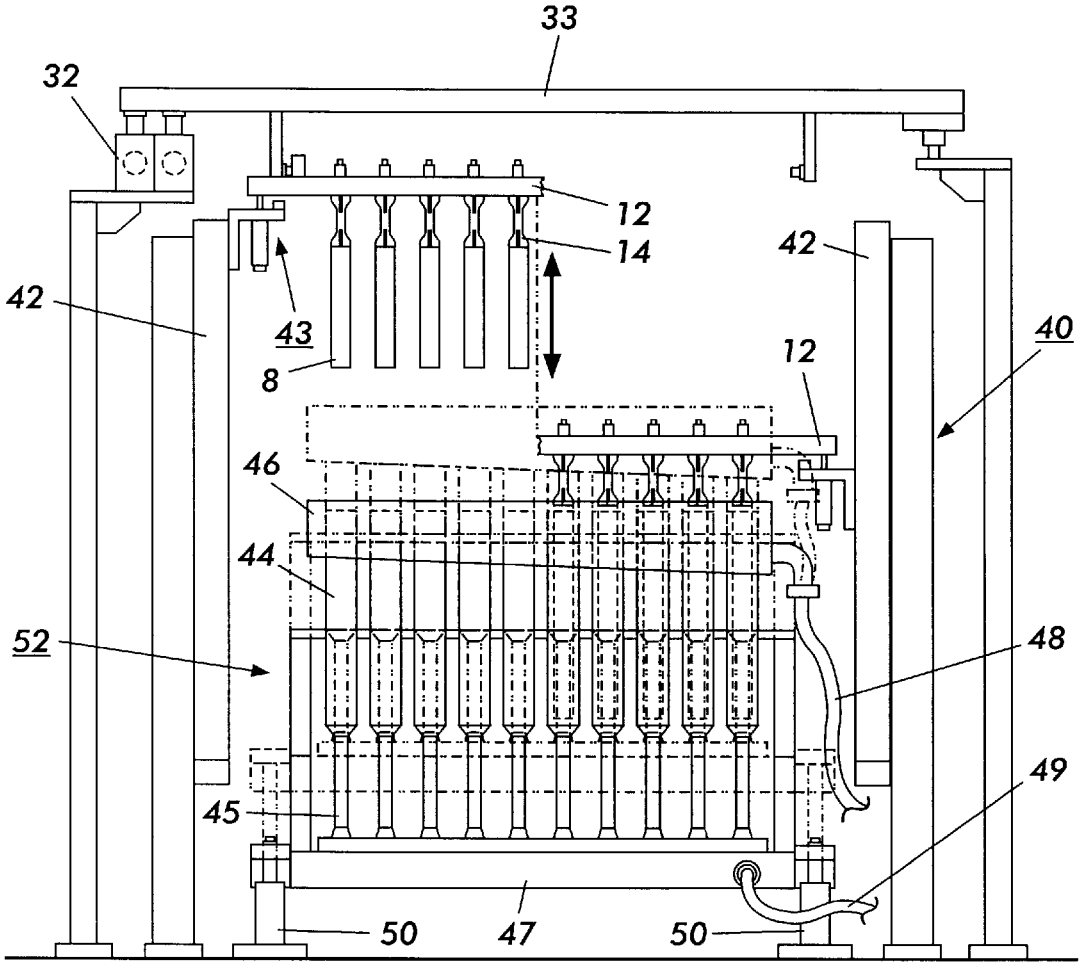
FIG. 2 is a schematic front view showing a cell of the dip coat process material handling system of FIG. 1.
Figure 3:
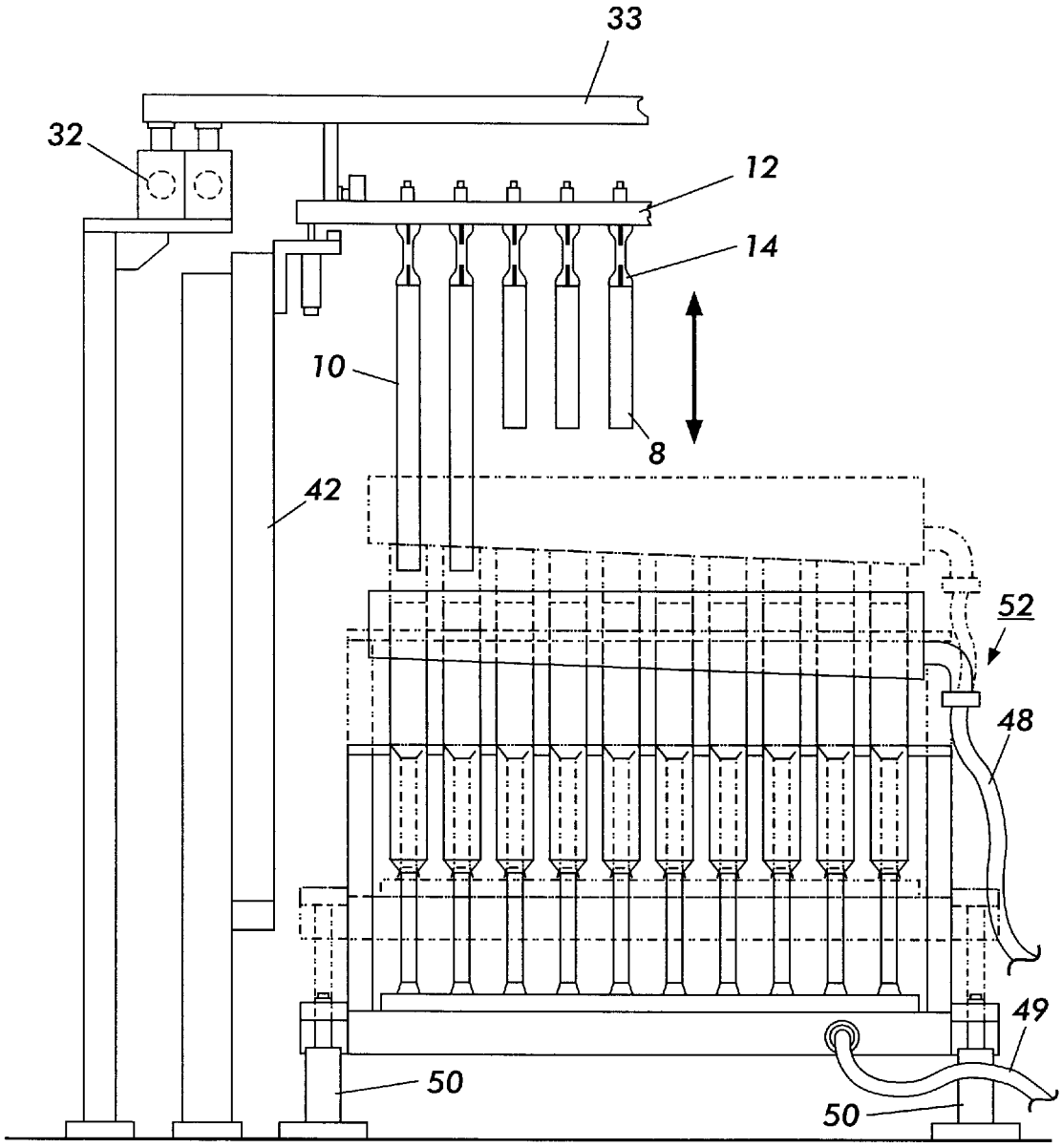
FIG. 3 is a modified expanded schematic front view showing a cell of the dip coat process material handling system of FIG. 2.

Referring to FIGS. 1, 2 and 3, a dip coat process material handling system in accordance with the present invention is illustrated. The dip coat process material handling system of the present invention comprises a dip coating cell 30.

Articles to be dip coated, referred to generally herein as workpieces and in this particular case, short hollow pipes or drums 8 or long hollow pipes or drums 10, are placed carrier device or pallet 12. For purposes of simplified illustration only, this short pipe 8/long pipe 10 alternative arrangement is diagrammatically shown if FIG. 2 by the contrasting offset positions of halves of the carrier pallet 12. In FIG. 3, the carrier pallet 12 is shown, also for purposes of illustration only, with both short hollow pipes 8 and long hollow pipes 10. Normally, carrier pallet 12 carries hollow pipes of the same size during any given coating run. The carrier pallet 12 includes a plurality of mandrels 14 each having a conventional chucking device (not shown) associated therewith for receiving individual workpieces thereon. In a preferred embodiment, the carrier pallet 12 incorporates an array of mandrels in a matrix array so as to carry multiple workpieces. The workpieces may be simultaneously loaded onto carrier pallet 12 from a load pallet (not shown) and, after coating, simultaneously deposited back on a load pallet (not shown). Loading and unloading may be effected by simply engaging or disengaging, respectively, the chucking device 15 on carrier pallet 12. Such loading and unloading is known and discussed, for example, in U.S. Pat. No. 5,334,346, the entire disclosure thereof being incorporated herein by reference.

Mandrel 14 and chucking device 15 assembly shown in FIG. 2 dip coating of hollow pipes may be employed for manufacturing electrophotographic imaging members. A detailed description of various mandrels and chucking devices suitable for use in the present invention are provided in patents including, for example, U.S. Pat. Nos. 5,320,364, 5,322,300, 5,328,181 and 5,324,049, the entire disclosures of these patents being incorporated by reference. It will be understood, however, that the present invention can be incorporated to process a variety of different articles such that the carrier pallet 12 can be equipped with any suitable fixtures for engaging and disengaging the workpieces. In one specific chuck design embodiment, the chucking device (not shown) associated with carrier pallet 12 is designed to engage each pipe along its inside diameter by applying pressure against a resilient member located opposite the chucking device. By engaging the pipe along the inside diameter, the chucking device creates a fixed volume cavity within the pipe for regulating the incoming interior solution level. This specific chuck design also prevents contamination of the outside diameter of the pipe by eliminating chuck and pipe interaction along the exterior periphery thereof.

The dip coating cell 30 will now be further described with reference to FIGS. 1, 2 and 3. The description, as well as the claims, of the present invention, as provided herein, make frequent use of the terms "horizontal" and "vertical". It is intended that these terms be used quite literally throughout the description as well as the claims, such that "horizontal" defines a plane substantially parallel to the horizontal and "vertical" defines a plane substantially perpendicular to the horizon. Dip coating cell 30 houses a plurality of dip stations 40 and comprises a dip horizontal transport system 32 including two horizontal transport carts 33 and 34 as well as a plurality of dip vertical transport systems 42 configured in alignment with each dip station 40. The dip horizontal transport system 32 provides the capability of transporting the carrier pallet 12 in a substantially horizontal plane in a continuous, in-line manner, while each dip vertical transport system 42 provides the capability of transporting each carrier pallet 12 in a substantially vertical plane for placing the workpieces into and out of each dip station 40. Each dip vertical transport system 42 also includes a transfer system 43 for transferring the carrier pallet 12 between the horizontal transport system 32 and each respective vertical transport system 42. As shown most clearly in of FIGS. 2 and 3, the transfer system 43 includes a movable arm for engaging with the carrier pallet 12 to raise and lower the carrier onto and off of the horizontal transport cart 33. In operation, the horizontal transport system via transport unit 33 or 34 transports a loaded carrier pallet 12 into position in alignment with a particular vertical transport system 42. The transfer system 43 is then activated to lift and support the carrier pallet 12 as the transfer cart 33 is moved aside so that the carrier pallet 12 can be lowered and raised by the vertical transport system 42. The vertical transport system 42 then transports the carrier pallet 12 along with the workpieces loaded thereon into the associated dip station 40. After the dip process is completed the transport and transfer process is reversed so as to reposition the carrier pallet 16 onto a transport cart 33 or 34. Although an opposed pair of vertical transport systems 42 are shown in FIGS. 2 and 3, other suitable arrangements may be employed instead such as a cantilevered arm that is vertically moved along a single vertical support. (not shown).

In an illustrative embodiment, the dip coating cell 30 includes three dip stations 40: a first dip station for providing an undercoating layer; a second dip station for providing a charge generating layer; and a third dip station for providing a charge transport layer. However, it will be understood by those of skill in the art, that the dip coating cell 30 can be expanded or reduced to provide as many dip stations 40 as required by the specific dip coating process being implemented. Alternatively, or additionally, the dip coating cell 30 can be expanded to provide additional dip stations including various other solutions for permitting variations in dip coating solutions which could permit co-processing of different products in the process material handling system of the present invention. For example, with reference to FIG. 1, an additional dip station and corresponding dip vertical transfer system can be installed at the end of the dip coating station, generally indicated by reference numeral 41 as an auxiliary dip station. Alternatively, or additionally, the dip coating cell 30 can be expanded to provide additional capability to remove at least part of the coating on the lower portion of the drum by at least partially inserting the first and second drum, respectively, into a solvent bath. For additional flexibility, each dip station 40 can be mounted onto a transport truck (not shown) to allow relatively simple interchangeability of dip coating solutions within the dip coating cell 30.

In the illustrative embodiments shown in FIGS. 2 and 3, each dip station comprises a plurality of coating bath containers or discrete dip tanks 44 for receiving an individual workpiece therein. Each dip tank 44 is provided with an infeed nozzle 45, preferably located at the base of each tank 44, and is further mounted to an overflow retrieval vessel 46 located adjacent the opening at the upper end of the dip tank 44. The infeed nozzles 45 are coupled to a manifold 47. Overflow retrieval vessel 46 and manifold 47 are connected through flexible couplings 48 and 49, respectively, to a solution recirculation system (not shown) for continuously recirculating the solution in the dip tanks 44 through a filtering and environment control system such that the solution in each dip tank 44 can be filtered and maintained at a constant temperature and viscosity. Each dip tank 44 may also include a water jacket or other suitable system for maintaining constant temperatures within the dip tank. This dip station 40 design, including individual dip tanks 44 enhances the capability of each dip station 40 system to maintain uniformity in the solution being deposited on the workpiece and decreases the surface area from which solvents may be dissipated. However, although less desirable, a single large tank may be utilized to simultaneously coat a plurality of workpieces instead of separate dip tanks for each workpiece. The dip tanks 44, infeed nozzles 45, and overflow retrieval vessel 46 are mounted on manifold 47 to form a rigid coating bath assembly 52. Manifold 47, in turn, is supported on a mechanism for raising and lowering the coating bath container such as hydraulic jacks 50 connected to a hydraulic pump (not shown). The jacks 50 are activated to raise the coating bath assembly 52 a predetermined distance from at least a lower first position to at least a second higher position (illustrated by phantom lines) when the coating runs are switched from coating long pipes 10 to coating short pipes 8. When the coating runs are switched from coating short pipes 8 to coating long pipes 10, the hydraulic jacks are activated to lower bath assembly 52 predetermined distance from the higher position to the lower position. The bath assembly 52 is stationary during the dipping of workpieces in and withdrawal of workpieces from the coating bath. Although hydraulic jacks are illustrated in FIGS. 2 and 3, any other suitable mechanism for raising and lowering the coating bath assembly 52 may be utilized. Typical raising and lowering mechanisms include, for example, ball screws, air cylinders, manually cranked jacks, and the like. Also, where only a single coating tank is employed, the manifold may be omitted. Further, if desired, the overflow retrieval vessel may be omitted. Where the manifold is omitted, the coating tank or tanks may be raised and lowered by any suitable mechanism directly attached to the tanks or to brackets, collars, platforms and the like that support the tanks.

Each dip vertical transport system 42 includes a selectively variable drive system for selectively varying the distance, and optionally the velocity, at which the carrier pallet 12 is raised and lowered. Thus, the carrier pallet 12 can be lowered during one coating run to a predetermined first position for a first length of photoreceptor drum and lowered during a different coating run to a predetermined second position for a second different length of photoreceptor drum. If desired, the carrier pallet 12 can also be lowered at a first fixed velocity to a point where the workpieces are just above the dip tanks 44 and then lowered at a second predetermined fixed velocity into each dip tank 44. If desired, the drive system may raise and lower the carrier pallet 12 at a constant velocity from the upper home position down and into the dip tanks 44. Any suitable transport device for vertically transporting the carrier device may be utilized for vertical transport system 42. Typical transport devices include, for example, precision ball screw and servo motor, and the like. The dip vertical transfer system 42 is brought to a stop for a predetermined period of time at a lower limit to allow the solution in each dip tank to come to a state of equilibrium while the workpiece is suspended at a position corresponding to the level at which the coating material is to be deposited onto the workpiece. Thereafter, the dip vertical transfer system 42 raises the workpieces out of the dip tank 44 at a predetermined velocity corresponding to the appropriate specification of the dip coating process as determined by the thickness of the desired coating, the viscosity of the coating solution, and other factors and then back to the dip horizontal transfer system 32 at another selected speed. Thus, the workpieces can be raised slowly from the dip tanks 44 at a particular velocity which is determined to prevent the formation of air bubbles or other inconsistencies in the coating and, upon complete removal of the workpiece from the dip tank 44, the workpieces will be transported at a second, preferably increased velocity, to bring the carrier pallet 12 into alignment with the dip horizontal transfer system 32 for transfer thereto.

Dip coating cell 30 may also comprise a flash-off station 48 for solvent vapor removal. No vertical transport system is required at the flash-off station as the workpieces are merely permitted to remain idle for a predetermined period of time to allow vapors to dissipate. The flash-off station 48 may include a blower system (not shown) for exposing the workpieces to a laminar downward airflow to allow more appropriate solvent vapor removal.

The dip coat cell 30 may also include an exchange platform 36 for transferring the carrier pallet to a drying/cooling booth (not shown). The drying/cooling booth may comprise any suitable drying oven unit and cooler unit (not shown).

The dip coat process enabled by the present invention will now be described with reference to all of the FIGS. and the structural elements described herein.

The first dip horizontal transfer cart 33 transports the loaded carrier pallet 12 into position over a predetermined dip station 40. The carrier pallet is loaded with long drums 10. At this point, the carrier pallet 12 is transferred to the dip vertical transfer system 42 corresponding to the specific dip station 40 via a transfer system 43. The dip vertical transport 42 receives the carrier pallet 12 from the first dip horizontal transfer cart 33 and lowers the loaded carrier pallet 12 into the dip coating tank 44. Meanwhile, the first horizontal dip transfer cart 33 returns to its initial position for receiving subsequent carrier pallets 12, thereby providing a parallel processing capability within the dip coating cell 30. After a predetermined amount of time, the carrier pallet 12 that has been lowered from a home position down to the dip tank 44 is elevated by means of the dip vertical transfer system 42 and returned to the dip horizontal transfer system 32. At this point, the second dip horizontal transfer cart 34 is moved into position for receiving the carrier pallet 12 from the dip vertical transport 42 and transports the loaded carrier pallet to the flash-off station 48. In another coating run with short drums 8, the same coating process is repeated except that the dip tanks 44 are raised by raising the bath assembly 52 with jacks 50 to a higher position so that carrier pallet 12 avoids travel through dead space prior to dipping the drum 8 in the coating bath. The bath assembly 52 is stationary at the time the carrier pallet 12 is lowered to the dip tank 44 from the home position. For handling both long and short drums in different coating runs, the apparatus employed should be provide with sufficient vertical space between the coating pallet in the home position and the upper surface of the coating bath when the dip tank is in a lower location to accommodate the longest drum. When shorter drums are coated, the dip tank must be raised through the additional vertical "dead space" prior to dip coating.

After sufficient solvent dissipation at the flash-off station, the carrier pallet 12 is transported to a drying/cooling (not shown).

The processed workpieces may then transferred to various other post-processing stations which may include, for example, a laser ablation station (not shown) for removing dip coating layers from the inside and outside diameters along the bottom of the workpieces.

While the description of the operation of the present invention is directed toward a system that cycles workpieces through the dip cell for multi-layer processing, it will be recognized that various dip coat processes may be implemented through the use of the present invention, including for example, a single-layer dip coating process.

It will be evident by those of skill in the art that the control operation of the present invention can be carried out either manually or by various automatic systems which may include various sensing devices coupled to a central programmable logic control unit (PLC) (not shown) or to a series of independent central programmable logic control units for providing semi-automatic processing capability. One such control operation systems is the PLC-5 series programmable controller including input/output modules available through Allen-Bradley Company of Milwaukee, Wis. which permits entering and changing process parameters, such as distance of travel for dip vertical transport 42, distance of travel for jacks 50 for raising and lowering the dip tank 44, set points, alarm limits, and data table volumes, among other specific parameters through a programming panel and associated software. This control system may also provide all temperature control and timing functions.

It will be seen from the foregoing discussion of operation, that the present invention provides a flexible manufacturing system in which workpieces, and in particular, hollow pipes of different lengths in different coating runs, can be transported through a dip coat process material handling system without loss of cycle time when switching to the dip coating of shorter drums from the dip coating of long drums. The dip coat process handling system of the present invention also provides flexibility to allow for production of multiple products in different coating runs by raising and lowering dip tanks to different stationary positions for the processing of various workpieces having different lengths. Thus, the vertical position of the coating bath is adjustable through any suitable mechanism thereby eliminating the additional cycle time required to vertically move shorter drums through unused dead space. Although the dip coat material handling system of the present invention may be utilized for dip coating one drum a time in any given coating run, the simultaneous dip coating of a plurality of drums in a given coating run is preferred for higher throughput.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A material handling system similar to that illustrated in FIG. 2 may be used to coat different length drums on different coating runs. In an initial coating run, an aluminum drum having a diameter of 84 millimeters and a length of 500 millimeters is mounted in a carrier pallet for lowering from a home position down and into a coating bath comprising a solution of film forming material dissolved in a solvent. The coating bath is contained in a dip coating tank supported by hydraulic jacks. The distance between the upper surface of the coating bath and bottom of the drum when the carrier pallet is in the home position is 50 millimeters. The coating pallet carrying the drum is lowered vertically at a lowering speed of 1000 mm/minute to immerse in the bath all except the top 10 millimeters of the drum. The dip tank is stationary during immersion of the drum in the coating bath. The coating pallet and coated drum are then returned to the home position at a raising speed of 200 mm/minute. This dip coating cycle requires a cycle time of 162 seconds.

EXAMPLE II

The process described in Example I can be repeated with the same apparatus except that a short aluminum drum having a diameter of 30 millimeters and a length of 253 millimeters is substituted for the original long drum. The dip tank is maintained at the same location as in Example I. The distance between the upper surface of the coating bath and bottom of the drum when the carrier pallet is in the home position is 297 millimeters. The coating pallet carrying the short drum is lowered vertically at a lowering speed of 1000 mm/minute to immerse in the bath all except the top 10 millimeters of the drum. The dip tank is stationary during immersion of the drum in the coating bath. The coating pallet and coated drum are then returned to the home position at a raising speed of 200 mm/minute. This dip coating cycle requires a cycle time of 194.4 seconds. This is 106.9 seconds of lost time (17.8 seconds lost during lowering and 89.1 seconds lost while raising) due to reciprocating transport of the short drum through a dead zone of 247 millimeters in each direction during which time no coating is applied to the drum.

EXAMPLE III

The process describe in Example II can be repeated with the same apparatus except that the dip tank is elevated by hydraulic jacks to a second location that is 247 millimeters higher than the original location used in Examples I and II. The new distance between the upper surface of the elevated coating bath and bottom of the drum when the carrier pallet is in the home position is 50 millimeters. The coating pallet carrying the short drum is lowered vertically at a lowering speed of 1000 mm/minute to immerse in the bath all except the top 10 millimeters of the drum. The dip tank is stationary during immersion of the drum in the coating bath. The coating pallet and coated drum are then returned to the home position at a raising speed of 200 mm/minute. This dip coating cycle requires a cycle time of 148.2 seconds. This is 46.2 seconds less time than the dip cycle of Example II and a savings of 19.25 percent on a 4 minute cycle time.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A material handling system for dip coating at least a first drum having a first predetermined length in a first coating cycle and a second drum of a second different predetermined length in a different coating cycle comprising:

a carrier device for carrying at least one drum, a coating bath container for depositing a layer of coating material onto at least one drum, a mechanism for raising and lowering the coating bath container between at least a first position and a second position higher than the first position, and a transport device for vertically transporting the carrier device a first predetermined distance from a home position for the first drum and a second predetermined different distance from the home position for the second drum, the first predetermined distance from a home position for the first drum and the second predetermined different distance from the home position for the second drum being sufficient to at least partially insert the first drum and second drum, respectively, into the coating bath container while the coating bath container is stationary.

2. The material handling system of claim 1, wherein for a first drum having a predetermined length longer than the predetermined length of the second drum, the mechanism for raising and lowering the coating bath container is at the first position, and the transport device for vertically transporting the carrier device is adapted to vertically transport the first drum the first predetermined distance from the home position, the first predetermined distance being greater than the second predetermined different distance.

3. The material handling system of claim 1, wherein for a second drum having a predetermined length shorter than the predetermined length of the first drum, the mechanism for raising and lowering the coating bath container is at the second higher position, and the transport device for vertically transporting the carrier device is adapted to vertically transport the second drum the second predetermined distance from the home position, the second predetermined distance being shorter than the first predetermined distance.

4. A process for dip coating at least a first drum having a first predetermined length in a first coating cycle and a second drum of a second different predetermined length in a different coating cycle comprising:

in the first coating cycle positioning at a first location a coating bath for depositing a layer of coating material onto at least one drum, vertically transporting at least one first drum having a first predetermined length a predetermined first distance from a home position to bring the first drum into contact with the coating bath, vertically transporting the first drum back to the home position; and then in the different coating cycle positioning at a second location the coating bath for depositing a layer of coating material onto at least one drum, vertically transporting at least one second drum having a second different predetermined length a predetermined second different distance from the home position to bring the second drum into contact with the coating bath, and vertically transporting the second drum back to the home position, the first predetermined distance from the home position for the first drum and the second predetermined different distance from the home position for the second drum being sufficient to bring the first drum and second drum, respectively, into contact with the coating bath while the coating bath container is substantially stationary.

5. A process for dip coating according to claim 4, wherein for a first drum having a predetermined length longer than the predetermined length of the second drum, the first location of the coating bath is lower than the second location, and the first predetermined distance is longer than the second predetermined distance.

6. A process for dip coating according to claim 4, wherein for a second drum having a predetermined length shorter than the predetermined length of the first drum, the second location of the coating bath is higher than the first location, and the second predetermined distance is shorter than the first predetermined distance.

7. A process for dip coating according to claim 4, wherein the coating bath comprises a solvent.

8. A process for dip coating according to claim 7, wherein the first drum and the second drum have an upper end and a lower end and only a small portion of the lower end of the first drum and the second drum are contacted with the coating bath in respective coating cycles for an edge wipe treatment.

9. A process for dip coating according to claim 4, wherein the coating bath comprises a solvent and a film forming binder.

10. A process for dip coating according to claim 9, wherein the first drum and the second drum each have an outer surface and a major portion of the outer surface of the first drum and the second drum are contacted with the coating bath in respective coating cycles to deposit a coating.

11. A process for dip coating according to claim 10, wherein the coating comprises a charge generating material.

12. A process for dip coating according to claim 10, wherein the coating comprises a charge transport material.

13. A process for dip coating according to claim 10, wherein the coating comprises a blocking material.

* * * * *